US012336631B2

(12) United States Patent
Chambers

(10) Patent No.: US 12,336,631 B2
(45) Date of Patent: Jun. 24, 2025

(54) INDEPENDENTLY SLIDABLE SHELF CABINET STORAGE SYSTEM

(71) Applicant: Rev-A-Shelf Company, LLC, Louisville, KY (US)

(72) Inventor: Paul Franklin Chambers, Louisville, KY (US)

(73) Assignee: REV-A-SHELF COMPANY, LLC, Louisville, KY (US)

( * ) Notice: Subject to any disclaimer, the term of this patent is extended or adjusted under 35 U.S.C. 154(b) by 378 days.

(21) Appl. No.: 17/988,524

(22) Filed: Nov. 16, 2022

(65) Prior Publication Data

US 2023/0248146 A1 Aug. 10, 2023

Related U.S. Application Data

(60) Provisional application No. 63/307,935, filed on Feb. 8, 2022.

(51) Int. Cl.

| | |
|---|---|
| ***A47B 96/02*** | (2006.01) |
| ***A47B 46/00*** | (2006.01) |
| ***A47B 77/10*** | (2006.01) |
| ***A47B 81/00*** | (2006.01) |

(52) U.S. Cl.

CPC ..... *A47B 96/025* (2013.01); *A47B 46/00* (2013.01); *A47B 77/10* (2013.01); *A47B 81/002* (2013.01)

(58) Field of Classification Search

CPC ..... A47B 96/025; A47B 81/002; A47B 46/00; A47B 77/10

See application file for complete search history.

(56) References Cited

U.S. PATENT DOCUMENTS

| | | | | |
|---|---|---|---|---|
| 7,318,631 | B2 | 1/2008 | Kreyenkamp | |
| 9,119,470 | B2 | 9/2015 | Kreyenkamp et al. | |
| 9,462,884 | B2 * | 10/2016 | Hunter | A47B 81/002 |

(Continued)

FOREIGN PATENT DOCUMENTS

| | | | |
|---|---|---|---|
| KR | 100507947 | B1 | 8/2005 |
| KR | 20090000440 | U * | 1/2009 |
| KR | 20200001450 | U | 7/2020 |

OTHER PUBLICATIONS

Rev-A-Shelf, Solid Bottom Blind Corner Optimizer, at least as early as Feb. 1, 2022, pp. 1-2, available at URL https://rev-a-shelf.com/16698?

(Continued)

*Primary Examiner* — Stanton L Krycinski

(74) *Attorney, Agent, or Firm* — Crowell & Moring LLP

(57) ABSTRACT

A cabinet shelving system includes a first set of shelves and a second set of shelves each having an upper shelf. The first and second set of shelves may be mounted on a cabinet mounting frame. The cabinet mounting frame may be installed in an interior cavity of a cabinet. The cabinet mounting frame may be used to slide the second set of shelves within the interior cavity while the first set of shelves is outside the interior cavity. Each of the first set of shelves and the second set of shelves may be independent slid, using a pair of slide out slides, between inside and outside of the interior cavity. The upper shelf of the first set of shelves and the second set of shelves may slide from outside to inside the interior cavity independent of movement of the first shelf frame and the second shelf frame, respectively.

18 Claims, 4 Drawing Sheets

(56) References Cited

U.S. PATENT DOCUMENTS

| | | | | |
|---|---|---|---|---|
| 10,024,593 | B2 * | 7/2018 | Holm | F25D 23/10 |
| 11,253,063 | B2 * | 2/2022 | Chen | A47B 88/70 |
| 12,042,046 | B2 * | 7/2024 | Bonin | A47B 88/497 |
| 2006/0181183 | A1 * | 8/2006 | Galloway | A47B 81/002 312/311 |
| 2022/0007832 | A1 | 1/2022 | Chen | |

OTHER PUBLICATIONS

Rev-A-Shelf 5PSP Blind Corner Promo Video by KitchenSource.com, 10 pages, uploaded on Feb. 3, 2016 by user "KitchenSource". Retrieved from Internet: https://www.youtube.com/watch?v=pjOXDzQXc8w.

Extended European Search Report, dated Jun. 21, 2023, pp. 1-6, issued in European Patent Application No. 231554684, European Patent Office, The Hague, The Netherlands.

* cited by examiner

INDEPENDENTLY SLIDABLE SHELF CABINET STORAGE SYSTEM

PRIORITY

This application claims priority to U.S. provisional application Ser. No. 63/307,935, filed Feb. 8, 2022, which is entirely incorporated by reference.

FIELD

The present disclosure relates generally to a cabinet storage system for use in a cabinet or other enclosure.

BACKGROUND

Cabinets such as storage cabinets for kitchens, bathrooms, closets, offices and other uses can include one or more receptacles, such as drawers or shelves for storing articles. The drawers and shelves can be designed to be moved between an open position and a closed position. While in the open position, a drawer or shelf may be extended away from the storage cabinet or other enclosure so as to receive the articles. In the closed position, the drawer or shelf may be recessed within the storage cabinet or other enclosure in which the drawer or shelve is installed. Individual sections of cabinets may extend in one or more directions. Where multiple cabinets are used, the individual cabinets may be positioned to extend linearly or at some angle, such as a ninety-degree angle, with respect to each other. Where cabinets are aligned at some angle, receptacles, such as a lazy susan shelf, may be installed to use the resulting interior area of the cabinet.

DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
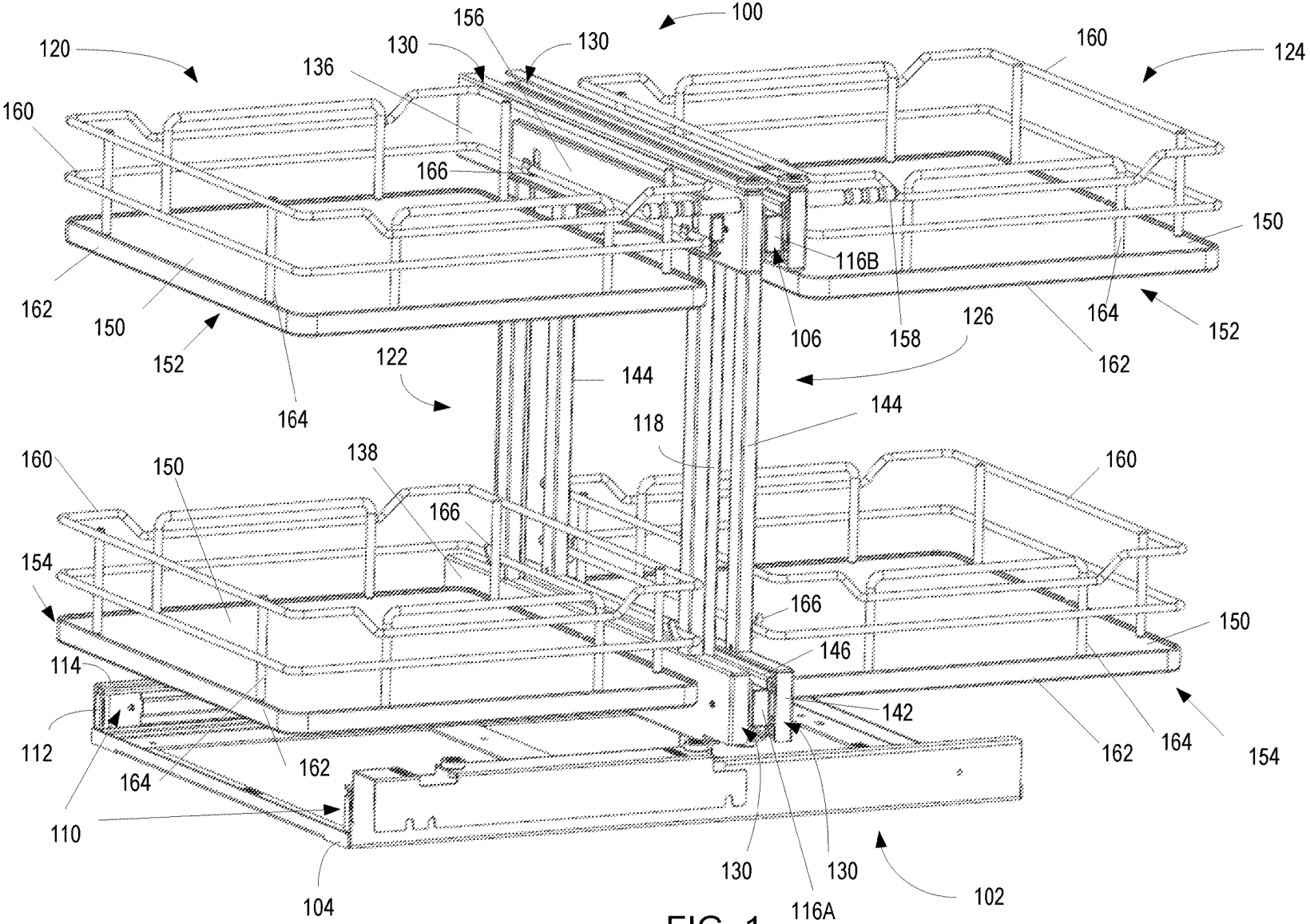
FIG. 1 is a front perspective view of an example cabinet shelving system.

FIG. 1 is a front perspective view of an example cabinet shelving system 100. The cabinet shelving system 100 may be mounted in a cabinet or other enclosure. The cabinet shelving system 100 includes a cabinet mounting frame 102 having a base 104 and a frame mounting member 106. The base 104 may be a rigid material, such as metal, or wood, or engineered wood, designed for rigidly and fixedly mounting the cabinet shelving system 100 in a cabinet, such is in the bottom of a cabinet, using fasteners, such as screws, adhesives and the like. The cabinet mounting frame 102 may also include a pair of base slides 110 in the base 104.

The base slides 110 may be telescoping slide members which include a slideable portion 112 and a fixed base portion 114. In the illustrated example of FIG. 1, the slidable portion 112 is coupled with the frame mounting member 106, and the fixed base portion 114 may be coupled with the bottom of the cabinet, so that the slidable portion 112 and the frame mounting member 106 are movable together within a cabinet.

The frame mounting member 106 may include a lower support 116A and an upper support 1168 coupled by one or more extension arms 118 using screws, bolts, welds or the like. The extension arms 118 may rigidly maintain the lower support 116A and the upper support 1168 in parallel. In addition, the extension arms 118 may couple the frame mounting member 106 with the base 104, such as by screws, bolt, welds or the like.

The cabinet shelving system 100 may also include a first set of shelves 120 mounted to a first shelf frame 122, and a second set of shelves 124 mounted to a second shelf frame 126. Each of the first shelf frame 122 and the second shelf frame 124 are mounted on the frame mounting member 106 by a respective pair of slide out slides 130. Thus, each of the first shelf frame 122 and the second shelf frame 124 may be independently moved, by the respective pair of slide out slides 130, between an interior cavity of a cabinet in which the cabinet shelving system 100 is mounted, and outside the interior cavity of the cabinet by a user.

The pair of slide out slides 130 include an upper slide out slide 136 and a lower slide out slide 138, which may be telescoping slide members having a slideable portion 142 coupled by an upright 144 to be rigidly held in parallel, and a fixed base portion 146 coupled with the lower support 116A of the frame mounting member 106. In the example of FIG. 1, each of the first shelf frame 122 and the second shelf frame 124 include two uprights 144 rigidly coupling the upper and lower slide out slides 136 and 138. In other examples additional or fewer uprights 144 may be used to maintain the upper and lower slide out slides 136 and 138. The pair of slide out slides 130 and the upright(s) 144 extending between the slides 136 and 138 may be formed of a rigid material, such as metal or plastic. Coupling of the pair of slide out slides 130 to respective frame mounting member 106 and upright(s) 144 may be by fasteners, such as screws, nuts and bolts, welding, or the like.

Each of the first set of shelves 120 and the second set of shelves 124 may include two or more planar shelves having planar opposing surfaces 150. In the illustrated example of FIG. 1, each set of shelves 120 and 124 includes an upper shelf 152 and a lower shelf 154. In other examples, additional intermediate shelves may be included. The shelves may be wood, plastic, or some other rigid material. The first set of shelves 120 includes a plurality of planar shelves, including the upper shelf 152, having opposing planar surfaces and mounted in parallel on the first shelf frame 122. The second set of shelves 124 includes a plurality of planar shelves, including the upper shelf 152, having opposing planar surfaces and being mounted in parallel on the second shelf frame 124.

The upper shelf 152 may slideably mounted on the upper slide out slide 136 with a shelf slide 156. The shelf slide 156 may be, for example, a ball bearing slide that is mechanically coupled with the upper slide out slide 136 by fasteners, such as screws, welding, or the like. The upper shelf 152 may be slid with respect to the frame mounting member 106 independent of the bottom shelf 154 using the shelf slide 156. Alternative, the upper shelf 152 and the bottom shelf 154 may be slid together with respect to the frame mounting member 106 such that the upper shelf 152 moves in unison with the bottom shelf 154 using the pair of slide out slides 130. In this way, when, for example, a user wishes to access to the contents of the bottom shelf 154 from above, which is possible when the cabinet shelving system 100 is mounted in the bottom of a cabinet mounted at the floor level, the first or second set of shelves 120 or 124 may be independently slid out of the cabinet, and then the upper shelf 152 may be independently slid back into the cabinet to access the contents of the bottom shelf 154. The first and second set of shelves 120 and 124 may be slid out of a cabinet by a user grasping a handle 158 coupled with the slidable portion 142 of the respective upper slide out slide 136. In other examples, the handle 158 may be omitted or positioned/designed differently to facilitate slidable extraction of the first and second set of shelves 120 and 124 from a cabinet.

Each of the upper and lower shelves 152 and 154 include a rail 160 contacting and extending above the planar surface 150. The rail 160 may be positioned around a peripheral edge 162 of the respective upper and lower shelves 152 and 154. The rail 160 may be coupled with the planar surface 150 by, for example, fasteners such as threaded bolts extending through the opposing (top and bottom) planar surfaces 150 of the respective shelf and threaded into posts 164 included as part of the rails 160. The upper shelves 152 may be coupled with the shelf slide 156 by a latch 166. The latch 166 may be fixedly coupled with the shelf slide 156 by, for example welding, a fastener or the like. The latch 166 may receive and engage with rail 160 to rigidly hold the upper shelf 152. In the illustrated example, two latches 166 are illustrated to engage and rigidly engage the rail 160. In other examples fewer or greater numbers of latches 166 may be present. In other examples with intermediate shelves between the upper and lower shelves 152 and 154, the intermediate shelve(s) may similarly be slidably coupled with a shelf slide 156 by one or more latches 166.

The lower shelf 154 of each of the first and second set of shelves 120 and 124 may be coupled with respective lower slide out slide 138, by fasteners, such as screws extending through the lower slide out slide 138 and into the peripheral edge 162 of the respective lower shelf 154. In addition, the rail 160 of the lower shelf 154 may engage latches 166 fixedly coupled with respective uprights 144 to torsionally support the fasteners extending through the lower slide out slide 138 and into the respective lower shelf 154. In contrast to the upper shelf 152, which is coupled with shelf slide 156, the shelf slide 156 is omitted for the lower shelf 154, which is coupled directly with the lower slide out slide 138 by the fasteners extending through the lower slide out slide 138 and into the peripheral edge 162 of the respective lower shelf 154.

Figure 2:
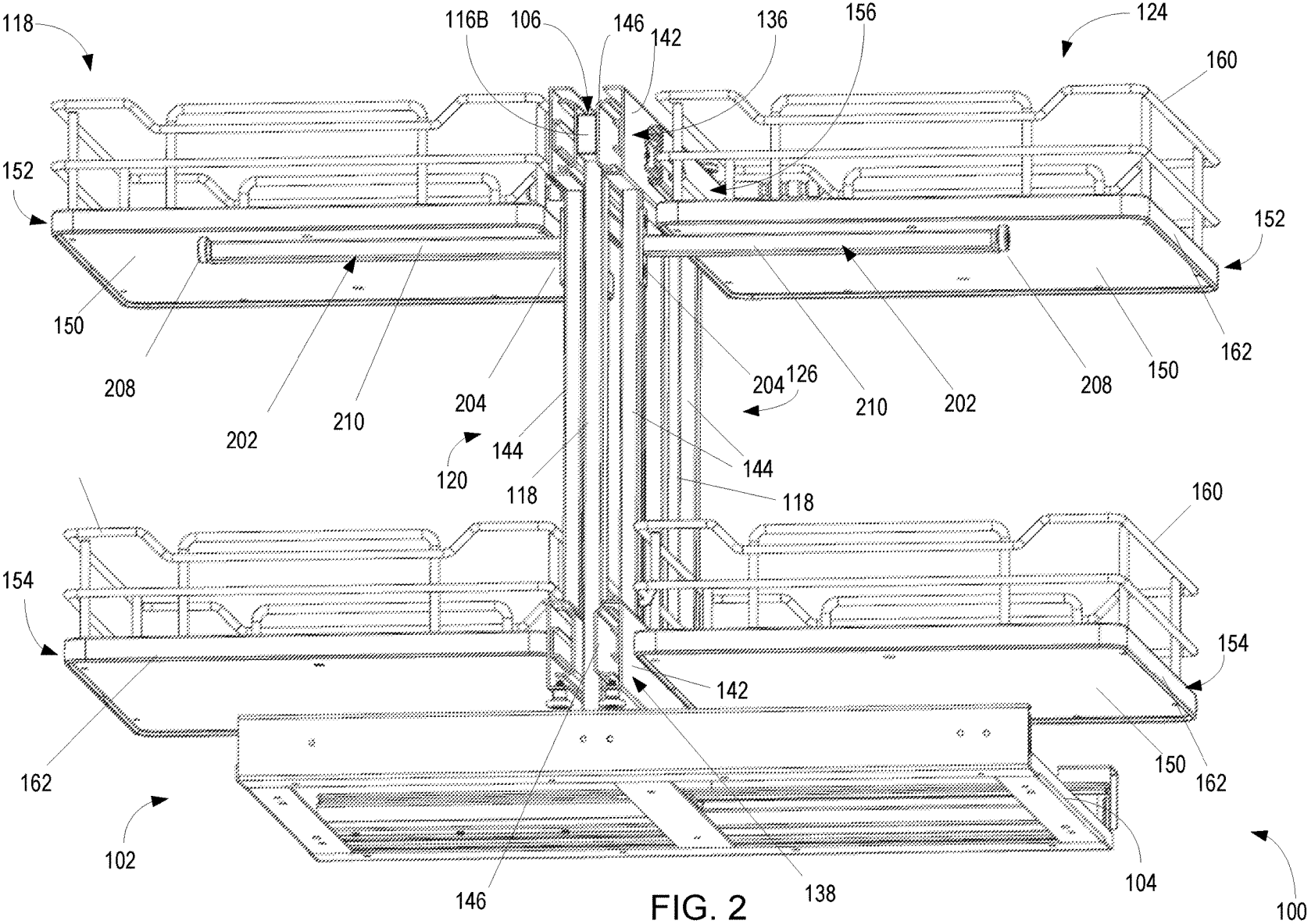
FIG. 2 is a rear perspective view of an example cabinet shelving system.

FIG. 2 is a rear perspective view of an example cabinet shelving system 100. In FIG. 2, the first set of shelves 120 and the second set of shelves 124 are slidably coupled with the cabinet mounting frame 102 by the respective first and second shelf frames 122 and 126 similar to FIG. 1. In addition, the base 104 of the cabinet mounting frame 102 may be slideably coupled with the frame mounting member 106. The features and functionality of the cabinet shelving system of FIG. 1 are fully applicable to and useable with the cabinet shelving system of FIG. 2, and the features and functionality of the cabinet shelving system of FIG. 2 are fully applicable to and useable with the cabinet shelving system of FIG. 1. For purposes of brevity, the following discussion will focus on aspects not previously discussed with reference to FIG. 1.

The frame mounting member 106 includes upper support 116B rigidly coupled by extension arms 118 with the pair of base slides 110 (FIG. 1). As also illustrated in FIG. 2, the fixed base portion 146 of the upper slide out slides 136 of both the first and second set of shelves 120 and 124 are fixedly coupled on opposite sides of the upper support 116B. In addition, in this example, the fixed base portion 146 of the lower slide out slides 138 are fixedly coupled on opposite sides of the uprights 144, and the lower shelves 154 are fixedly coupled with the slideable portion 142.

Each of the first shelf frame 122 and the second shelf frame 126 also include a cantilevered shelf support strut 202. The cantilevered shelf support strut 202 may be a rigid material, such as steel or plastic or the like. One end, or a first end, of the cantilevered shelf support strut 202 includes a foot 204 fixedly coupled with a respective upright 144 of the first shelf frame 122 or the second shelf frame 126. The other end, or second end, of the cantilevered shelf support strut 202 includes a glide support 208. The glide support 208 may contiguously contact one of the opposing planar surfaces 150 (the bottom planar surface) of the upper shelf 152. In the illustrated example, each of the first shelf frame 122 and the second shelf frame 126 include only one cantilevered shelf support strut 202. In other examples, multiple cantilevered shelf support struts 202 may be included, such as a cantilevered shelf support strut 202 coupled with each of the uprights 144.

The cantilevered shelf support strut 202 may extend away from the shelf slide 156 and include a beam 210 extending in parallel with the planar surface of the upper shelf 152 between the foot 204 and the glide support 208. The rail 160 may be coupled with the other of the opposing planar surfaces 150 (the top planar surface) with fasteners, such as threaded fasteners 216 coupled with threaded posts 164 through the planar upper shelf 152.

The glide support 208 may contiguously glide along bottom planar surface of the upper shelf 152 as the upper shelf 152 is moved with the shelf slide 156 with respect to the first or second shelf frame 122 or 126. Accordingly, the cantilevered shelf support strut 202 may provide structural support of the upper shelf 152 in whatever position the upper shelf 152 is in with respect to the first or second shelf frame 122 or 126. When contents are placed in the upper shelf 152, the cantilevered shelf support strut 202 operates cooperatively with the latch 166 (FIG. 1) to support the load. Due to the glide support 208 being extended away from the shelf slide 156 where the latch 166 is coupled, the cantilevered weight of the load created by the content in the upper shelf 152 is borne by the respective upright 144 to which the cantilevered shelf support strut 202 is coupled. Thus, the cantilevered shelf support strut 202 cooperatively operates with the latch 166 to arrest concentric rotational forces on the rail 160 in the latch 166 that would otherwise occur if the cantilevered shelf support strut 202 was absent.

The glide support 208 may be a roller, a low friction material, a ball, or other rigid material or device that allows the cantilevered shelf support strut 202 to support a load generated by contents in the upper shelf 152. In an example, the glide support 208 may be a roller in constant contiguous contact with the planar surface of the upper shelf such that rotation of the roller is contemporaneous with slidable movement of the upper shelf 152. The roller may be cylindrical, round or some other shape capable of rotation, and the guide support 208 may include an appropriate holder of the roller to facilitate rotation. For example, the glide support 208 may include a roller in the form or a ball positioned in a holder in the form of a socket at the end of the beam 210 such that the ball spins in the socket when the upper shelf 152 is moved due to contiguous contact of the ball with planar surface 150 of the shelf.

Figure 3:
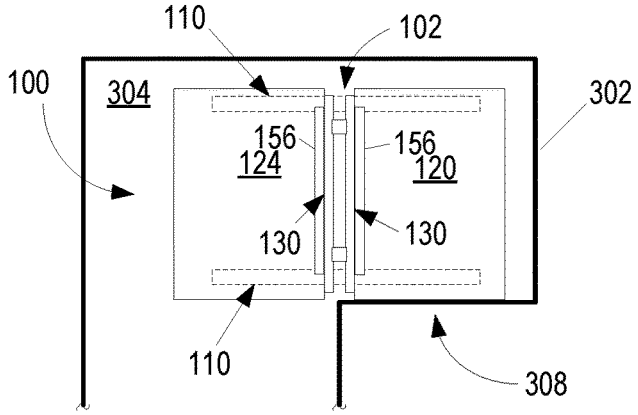
FIG. 3 is a top view schematic illustrating an example of a cabinet shelving system mounted in a cabinet.

FIG. 3 is a top view schematic illustrating an example of a cabinet shelving system 100 mounted in a cabinet 302. In FIG. 3, the cabinet shelving system 100 is fully within an interior cavity 304 included in the cabinet 302 and a countertop of the cabinet has been removed for purposes of explanation of the cabinet shelving system 100. The illustrated cabinet 302 may be referred to as a "blind corner" cabinet, which includes an inaccessible area 306 within the cabinet 302 that is not easily accessible by a user. In the illustrated example, the cabinet 302 is formed as a blind corner cabinet with two sections that form a ninety-degree angle. In other example cabinets, other angles may be used.

Similar to the examples of FIGS. 1 and 2, the cabinet shelving system 100 includes a first set of shelves 120 and a second set of shelves 124 that are slideably coupled with a cabinet mounting frame 102. The features and functionality of the cabinet shelving system of FIGS. 1 and 2 are fully applicable to, and useable with, the cabinet shelving system of FIG. 3, and the features and functionality of the cabinet shelving system of FIG. 3 are fully applicable to and useable with the cabinet shelving system of FIGS. 1 and 2. For purposes of brevity, the following discussion will focus on aspects not previously discussed with reference to FIGS. 1 and 2.

Referring to FIGS. 1-3, the cabinet mounting frame 102 is mountable in the cabinet 302 and includes a pair of base slides 110 coupled with the cabinet mounting frame 102 and a pair of slide out slides 130 coupled with the first set of shelves 120 and the second set of shelves 124. The first set of shelves 120 are positioned in the interior cavity 304 of the cabinet 302 closer than the second set of shelves 124 to an opening 308 in the cabinet 302 used to access the cabinet shelving system 100.

Figure 4:
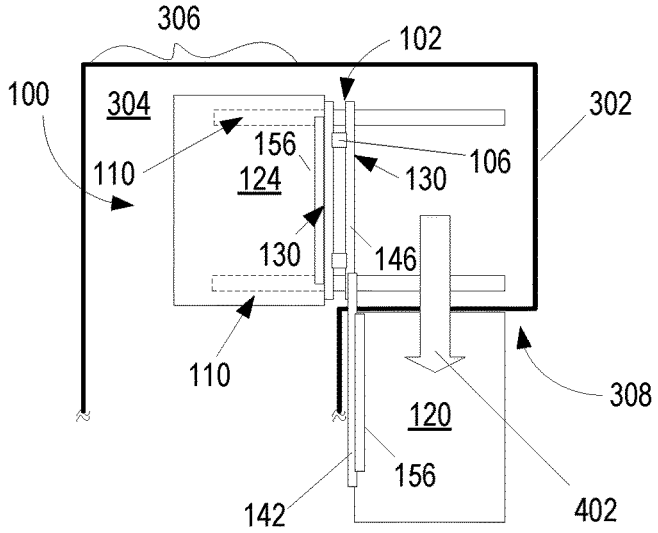
FIG. 4 is another top view schematic illustrating an example of a cabinet shelving system mounted in a cabinet.

FIG. 4 is another top view schematic illustrating an example of a cabinet shelving system 100 mounted in a cabinet 302. In the example of FIG. 4, a first set of shelves 120 is illustrated as slid on the pair of slide out slides 130 for the first set of shelves 120 from the interior cavity 304 of the cabinet 302 to be outside the interior cavity 304, as indicated by arrow 402. In this configuration, contents of the first set of shelves 120 are accessible since they are outside the interior cavity 304, however, contents on the second set of shelves 124 are inaccessible since they are located in the inaccessible area 306 of the cabinet 302. As illustrated in FIG. 4, the pair of slide out slides 130 for the first set of shelves 120 may be extended such that a slideable portion 142 of the slide out slides 130 extend outside the interior cavity 304, and a fixed base portion 146 of the slide out slides 130 coupled with a frame mounting member 106 included in the cabinet mounting frame 102 remain in the interior cavity 304.

Figure 5:
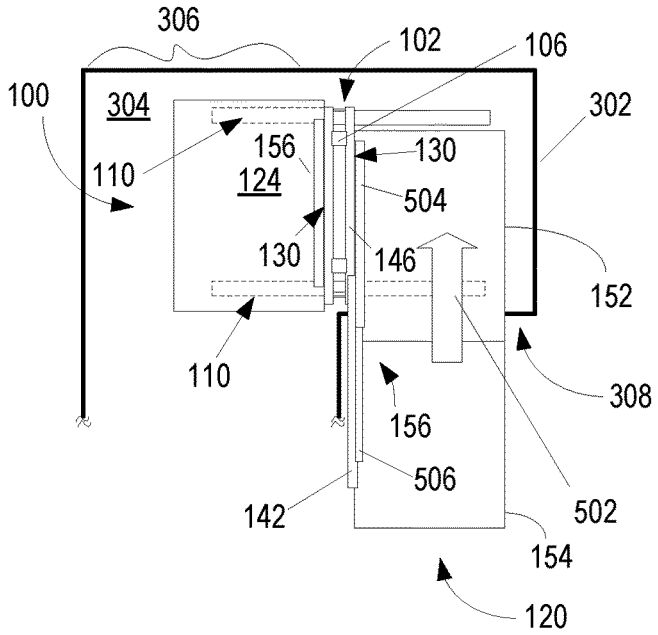
FIG. 5 is another top view schematic illustrating an example of a cabinet shelving system mounted in a cabinet.

FIG. 5 is another top view schematic illustrating an example of a cabinet shelving system 100 mounted in a cabinet 302. In the example of FIG. 5, a first set of shelves 120 is illustrated as slid on the pair of slide out slides 130 for the first set of shelves 120 from the interior cavity 304 of the cabinet 302 to be outside the interior cavity 304, similar to the example of FIG. 4. In addition, in this example, an upper shelf 152 included in the first set of shelves 120 is illustrated as being slid through the opening 308 and into the interior cavity 304 of the cabinet 302 as indicated by arrow 502. In this configuration, contents on the lower shelf 154 of the first set of shelves 120 are accessible by a user since they are outside the interior cavity 304 and unobstructed by the upper shelf 152, however, contents on the second set of shelves 124 are inaccessible since they are located in the inaccessible area 306 of the cabinet 302.

The upper shelf 152 is slid using a shelf slide 156 that slides independently, and in a direction parallel to, an upper slide out slide 136 of the pair of slide out slides 130. As illustrated in FIG. 5, the shelf slide 156 for the first set of shelves 120 may be extended such that a slideable portion 504 of the shelf slide 156 extends inside the interior cavity 304. A fixed base portion 506 of the shelf slide 156, which is coupled with a slideable portion 142 of the upper slide out slide 136 for the first set of shelves 120 remains outside the interior cavity 304. As further illustrated in FIG. 5, the pair of slide out slides 130 for the first set of shelves 120 may be extended such that a slideable portion 142 of the slide out slides 130 extend outside the interior cavity 304, and a fixed base portion 146 of the slide out slides 130 coupled with a frame mounting member 106 included in the cabinet mounting frame 102 remain in the interior cavity 304. The upper shelf 152 of the first set of shelves 120 may be slidable from outside to inside the interior cavity 304 independent of movement of the first shelf frame 122 and the second shelf frame 126.

In this way, the first set of shelves 120 may have an upper shelf 152 slideably mounted on the first shelf frame 122 to independently slide between the interior cavity 304 of the cabinet 302 and outside the interior cavity 304 when the first set of shelves 120 is slideably positioned outside the interior cavity 304. The upper shelf 152 may slide on the shelf slide 156 into the interior cavity only while the first set of shelves 120 are outside the interior cavity 304. In addition, the upper shelf 152 that is slideably mounted on the slideable portion 142 of the slide out slides 130 is independently slidable between the interior cavity 304 of the cabinet 302 and outside the interior cavity 304 only when the second set of shelves 124 are slideably positioned inside the interior cavity 304 as illustrated in FIG. 5.

Figure 6:
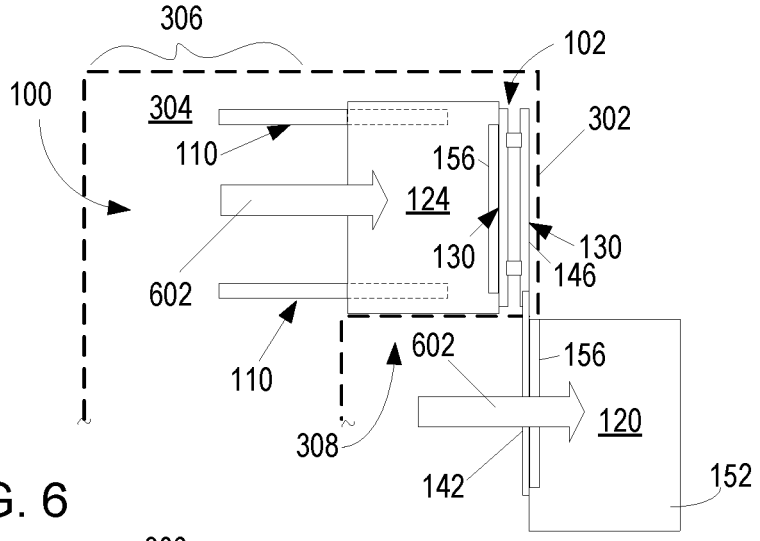
FIG. 6 is another top view schematic illustrating an example of a cabinet shelving system mounted in a cabinet.

FIG. 6 is another top view schematic illustrating an example of a cabinet shelving system 100 mounted in a cabinet 302. In the example of FIG. 6, a first set of shelves 120 is illustrated as slid on the pair of slide out slides 130 for the first set of shelves 120 from the interior cavity 304 of the cabinet 302 to be outside the interior cavity 304, similar to the example of FIGS. 4 and 5. In addition, as illustrated by arrows 602, the cabinet mounting frame 102 is slid on a pair of base slides 110 within the interior cavity 304 of the cabinet 302 to move the second set of shelves 124 out of the inaccessible area 306 and into the opening 308 in the cabinet 302. A base 106 (FIG. 1 or 2) of the cabinet mounting frame is illustrated as mounted in the cabinet 302, such as on the bottom of the cabinet 302. The base 106 includes a pair of base slides 110 coupled with the frame mounting member 102 such that the frame mounting member 102 and the second shelf frame 124 slide inside the interior cavity 304 in a direction perpendicular to the direction the pair of slide out slides 130 extend to move the first and second sets of shelves 120 and 124 out of the interior cavity 304 of the cabinet 302 through the opening 308.

Since the first set of shelves 120 is mounted on the cabinet mounting frame 102, the first set of shelves 120 is moved away from the opening 308 in the cabinet 302, as illustrated. Thus, the cabinet mounting frame 102 is slid on the pair of base slides 110 to slide the second set of shelves 124 within the interior cavity 304 while the first set of shelves 120 is outside the interior cavity 304. The upper shelf 152 must be slid on the shelf slide 156 to align with the lower shelf 154 in order for the first set of shelves 120 to not strike the cabinet 302 as the frame mounting member 102 is slid on the base slides 110. After the cabinet mounting frame 102 is slid in the interior cavity 304 the second set of shelves 124 are accessible by a user via the opening 308. In addition, the first set of shelves 120 are outside the interior cavity 304 of the cabinet 302 and are accessible to the user.

Figure 7:
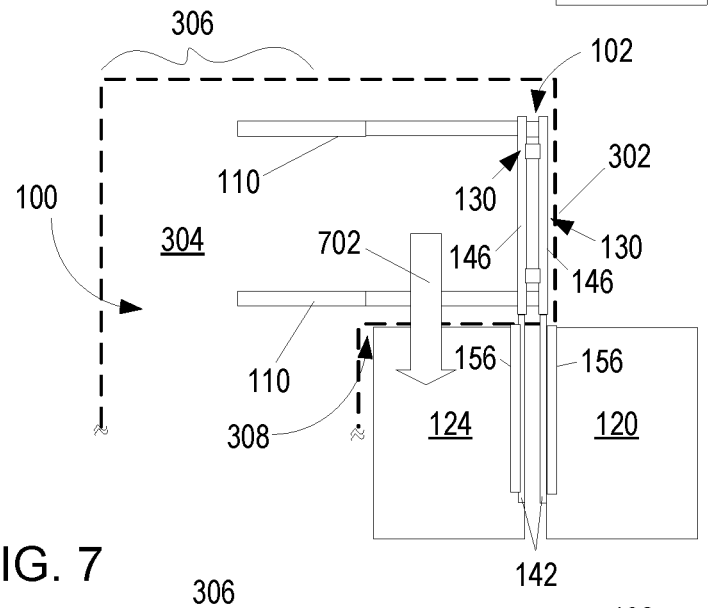
FIG. 7 is another top view schematic illustrating an example of a cabinet shelving system mounted in a cabinet.

FIG. 7 is another top view schematic illustrating an example of a cabinet shelving system 100 mounted in a cabinet 302. In the example of FIG. 7, the first set of shelves 120 are outside the interior cavity 304, and the cabinet mounting frame 102 is slid such that the second set of shelves 124 are aligned in the opening 308. In addition, in this example, the second set of shelves 124 are illustrated as slid on the pair of slide out slides 130 for the second set of shelves 124 from the interior cavity 304 of the cabinet 302 to be outside the interior cavity 304, as indicated by arrow 702. In this configuration, contents of the first set of shelves 120 are accessible since they are outside the interior cavity 304, and contents on the second set of shelves 124 are accessible since they are also located outside the interior cavity 304 of the cabinet 302. As illustrated in FIG. 7, the pair of slide out slides 130 for the first set of shelves 120 and the second set of shelves 124 may both be extended such that a slideable portion 142 of the slide out slides 130 extend outside the interior cavity 304, and a fixed base portion 146 of the slide out slides 130 coupled with a frame mounting member 106 included in the cabinet mounting frame 102 remain in the interior cavity 304.

Figure 8:
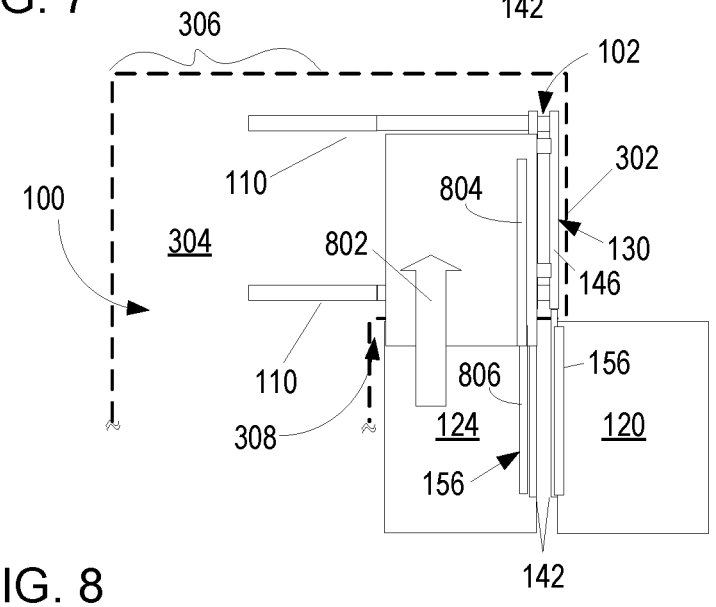
FIG. 8 is another top view schematic illustrating an example of a cabinet shelving system mounted in a cabinet.

FIG. 8 is another top view schematic illustrating an example of a cabinet shelving system 100 mounted in a cabinet 302. In the example of FIG. 8, the first set of shelves 120 are outside the interior cavity 304, and the cabinet mounting frame 102 is slid such that the second set of shelves 124 are aligned in the opening 308. In addition, in this example, the second set of shelves 124 are illustrated as slid on the pair of slide out slides 130 for the second set of shelves 124 from the interior cavity 304 of the cabinet 302 to be outside the interior cavity 304 similar to the example of FIG. 7. In addition, in this example, an upper shelf 152 included in the second set of shelves 120 is illustrated as being slid through the opening 308 and into the interior cavity 304 of the cabinet 302 as indicated by arrow 802. In this configuration, contents on the lower shelf 154 of the second set of shelves 120 are accessible by a user since they are outside the interior cavity 304 and unobstructed by the upper shelf 152. In addition, contents on the first set of shelves 120 are accessible since the first set of shelves 120 is outside the cabinet 302.

The upper shelf 152 is slid using a shelf slide 156 that slides independently, and in a direction parallel to, an upper slide out slide 136 of the pair of slide out slides 130. As illustrated in FIG. 8, the shelf slide 156 for the second set of shelves 120 may be extended such that a slideable portion 804 of the shelf slide 156 extends inside the interior cavity 304. A fixed base portion 806 of the shelf slide 156, which is coupled with a slideable portion 142 of the upper slide out slide 136 for the second set of shelves 124 remains outside the interior cavity 304. As further illustrated in FIG. 8, the pair of slide out slides 130 for the second set of shelves 120 may be extended such that a slideable portion 142 of the slide out slides 130 extend outside the interior cavity 304, and a fixed base portion 146 of the slide out slides 130 coupled with a frame mounting member 106 included in the cabinet mounting frame 102 remain in the interior cavity 304. The upper shelf 152 of the second set of shelves 124 may be slidable from outside to inside the interior cavity 304 independent of movement of the first shelf frame 122 and the second shelf frame 126.

In this way, the second set of shelves 124 may have an upper shelf 152 slideably mounted on the second shelf frame 126 to independently slide between the interior cavity 304 of the cabinet 302 and outside the interior cavity 304 when the second set of shelves 124 is slideably positioned outside the interior cavity 304. The upper shelf 152 may slide on the shelf slide 156 into the interior cavity 304 only while the second set of shelves 124 are outside the interior cavity 304. In addition, the upper shelf 152 that is slideably mounted on the slideable portion 142 of the slide out slides 130 is independently slidable between the interior cavity 304 of the cabinet 302 and outside the interior cavity 304 only when both the first set of shelves 120 and the second set of shelves 124 are slideably positioned outside the interior cavity 304 as illustrated in FIG. 8.

FIGS. 3-8 illustrate various examples of the cabinet shelving system 100 that are similar to FIGS. 1-2. The features and functionality of the cabinet shelving system of FIGS. 1 and 2 are fully applicable to, and useable with, the cabinet shelving system of FIGS. 3-8, and the features and functionality of the cabinet shelving system of FIGS. 3-8 are fully applicable to and useable with the cabinet shelving system of FIGS. 1 and 2. In addition, the features and functionality of the cabinet shelving system 100 of FIGS. 3-8 are fully applicable and useable together and/or interchangeably. Accordingly, for purposes of brevity, the discussion of all of FIGS. 1-8 has focused on aspects not otherwise discussed with reference to other of FIGS. 1-8. In addition, in other examples, the cabinet shelving system 100 may include other features and aspects. For example, the cabinet shelving system 100 may be used in any form of enclosure or cabinet in addition to "blind corner" cabinets. In addition, other forms of mechanisms may be used to accomplish the functional movement of the first and second sets of shelves as described herein. Further, in other examples, additional sets of shelves, such as a third set of shelves, may be used in cabinet shelving system.

It is now apparent that there are many advantages of the cabinet storage system provided herein. In addition to the advantages that have been described, it is also possible that there are still other advantages that are not currently recognized but which may become apparent at a later time.

While preferred embodiments of the cabinet storage system have been described, it should be understood that the disclosure is not limiting, and modifications may be made without departing from the features and functionality described. The scope of the disclosure is defined by the appended claims, and all devices that come within the meaning of the claims, either literally or by equivalence, are intended to embrace them.

The invention claimed is:

1. A cabinet shelving system comprising:

a first set of shelves mounted to a first shelf frame, and a second set of shelves mounted to a second shelf frame;

a cabinet mounting frame having a base and a frame mounting member, each of the first shelf frame and the second shelf frame independently and slideably mounted on the frame mounting member by a respective pair of slide out slides, the first shelf frame and the second shelf frame independently moveable, by the respective pair of slide out slides between an interior cavity of a cabinet and outside the interior cavity of the cabinet;

the first set of shelves having a first upper shelf slideably mounted on the first shelf frame to slide independently between the interior cavity of the cabinet and outside the interior cavity when the first set of shelves is slideably positioned outside the interior cavity; and the second set of shelves having a second upper shelf slideably mounted on the second shelf frame to slide independently between the interior cavity of the cabinet and outside the interior cavity when the second set of shelves are slideably positioned outside the interior cavity.

2. The cabinet shelving system of claim 1, wherein the first shelf frame includes a shelf slide slideably coupled with the first upper shelf to enable the first upper shelf to independently slide between the interior cavity of the cabinet and outside the interior cavity, and a cantilevered shelf support strut contiguously contacting a planar surface of the first upper shelf away from the shelf slide.

3. The cabinet shelving system of claim 2, wherein the cantilevered shelf support strut comprises a foot fixedly coupled with the first shelf frame, and a glide support contiguously contacting the planar surface of the first upper shelf.

4. The cabinet shelving system of claim 3, wherein each respective pair of slide out slides includes an upper slide out slide and a lower slide out slide, and the first shelf frame and the second shelf frame each comprising an upright coupled between the upper slide out slide and the lower slide out slide, the foot coupled with the upright of the first shelf frame.

5. The cabinet shelving system of claim 4, wherein the glide support comprises a roller in constant contiguous contact with the planar surface of the first upper shelf such that rotation of the roller is contemporaneous with slideable movement of the first upper shelf.

6. The cabinet shelving system of claim 1, wherein the first set of shelves includes a plurality of planar shelves, including the first upper shelf, having opposing planar surfaces and mounted in parallel on the first shelf frame and the second set of shelves includes a plurality of planar shelves, including the second upper shelf, having opposing planar surfaces and being mounted in parallel on the second shelf frame.

7. The cabinet shelving system of claim 1, wherein the base is mountable in the cabinet and includes a pair of base slides coupled with the frame mounting member such that the frame mounting member and the second shelf frame is slideable inside the interior cavity in a direction perpendicular to the respective pair of slide out slides.

8. The cabinet shelving system of claim 1, wherein the first upper shelf slideably mounted on the first shelf frame is independently slidable between the interior cavity of the cabinet and outside the interior cavity only when the second set of shelves are slideably positioned inside the interior cavity.

9. The cabinet shelving system of claim 1, wherein the second upper shelf slideably mounted on the second shelf frame independently slidable between the interior cavity of the cabinet and outside the interior cavity only when the first set of shelves and the second set of shelves are slideably positioned outside the interior cavity.

10. The cabinet shelving system of claim 1, wherein the first upper shelf is only slideable when the first set of shelves is slideably positioned outside the interior cavity and the second upper shelf is slideable only when the second set of shelves are slideably positioned outside the interior cavity.

11. A cabinet shelving system comprising:

a first set of shelves having a first upper shelf slideably mounted on a first shelf frame;

a second set of shelves having a second upper shelf slideably mounted on a second shelf frame;

the first shelf frame and the second shelf frame mounted on a cabinet mounting frame, the cabinet mounting frame mountable in an interior cavity of a cabinet and configured to slide the second shelf frame within the interior cavity while the first set of shelves is outside the interior cavity; and each of the first shelf frame and the second shelf frame comprising a pair of slide out slides to enable independent movement of the first shelf frame and the second shelf frame between inside and outside of the interior cavity, and the first upper shelf of the first set of shelves and the second upper shelf of the second set of shelves slidable from outside to inside the interior cavity independent of movement of the first shelf frame and the second shelf frame, respectively.

12. The cabinet shelving system of claim 11, wherein each of the pairs of slide out slides include an upper slide out slide and a lower slide out slide, and the first upper shelf and the second upper shelf each is slideably coupled with the upper slide out slide by a shelf slide, the shelf slide slideable independent of, and in a direction parallel to, the upper slide out slide.

13. The cabinet shelving system of claim 12, wherein the first upper shelf and the second upper shelf each includes opposing planar surfaces, and each of the first shelf frame and the second shelf frame includes a cantilevered shelf support strut extending away from the shelf slide and contiguously contacting one of the opposing planar surfaces to support the first upper shelf and the second upper shelf, respectively.

14. The cabinet shelving system of claim 13, wherein each of the first shelf frame and the second shelf frame include only one cantilevered shelf support strut.

15. The cabinet shelving system of claim 13, wherein the opposing planar surfaces are a top planar surface and a bottom planar surface and the first upper shelf and the second upper shelf each includes a rail coupled with and extending away from the top planar surface, wherein the first upper shelf and the second upper shelf each is coupled with the shelf slide by a latch engaged with the rail.

16. The cabinet shelving system of claim 15, wherein the bottom planar surface contiguously contacts a glide support included on the cantilevered shelf support strut to arrest concentric rotation of the rail in the latch.

17. The cabinet shelving system of claim 13, wherein the upper slide out slide and the lower slide out slide are rigidly held in parallel by an upright extending therebetween, and the cantilevered shelf support strut includes a first end coupled with the upright and a second end comprising a glide support in contiguous contact with the one of the opposing planar surfaces.

18. A cabinet shelving system comprising:

a first set of shelves and a second set of shelves, the first set of shelves having a first upper shelf and the second set of shelves having a second upper shelf;

a cabinet mounting frame, the first set of shelves and the second set of shelves mounted on the cabinet mounting frame, the cabinet mounting frame mountable in an interior cavity of a cabinet and configured to slide the second set of shelves within the interior cavity while the first set of shelves is outside the interior cavity;

a plurality of pairs of slide out slides coupled to the cabinet mounting frame, each of the first set of shelves and the second set of shelves coupled with and independently slideable between inside and outside of the interior cavity with a respective pair of slide out slides included in the plurality of pairs of slide out slides; and a plurality of shelf slides, the first upper shelf of the first set of shelves and the second upper shelf of the second set of shelves independently slidable with a respective shelf slide of the plurality of shelf slides from outside to inside the interior cavity independent of slideable movement of the first set of shelves and the second set of shelves, respectively.

* * * * *